United States Patent [19]

Eisenbacher

[11] Patent Number: 4,813,858

[45] Date of Patent: Mar. 21, 1989

[54] GEROTOR PUMP WITH PRESSURE VALVE AND SUCTION OPENING FOR EACH PRESSURE CHAMBER

[75] Inventor: Egon Eisenbacher, Karlstadt, Fed. Rep. of Germany

[73] Assignee: Mannesmann Rexroth GmbH, Lohr, Fed. Rep. of Germany

[21] Appl. No.: 51,618

[22] Filed: May 20, 1987

[30] Foreign Application Priority Data

May 20, 1986 [DE] Fed. Rep. of Germany ..... 3616959

[51] Int. Cl.[4] ..... F04C 2/10

[52] U.S. Cl. ..... 418/61.2

[58] Field of Search ..... 418/61 B, 270, 166, 418/171

[56] References Cited

U.S. PATENT DOCUMENTS

| | | | |
|---|---|---|---|
| 2,989,951 | 6/1961 | Charlson | 418/61 B |
| 3,185,386 | 4/1965 | Peras | 418/61 B |
| 3,302,584 | 2/1967 | McDermott | 418/61 B |
| 3,910,733 | 10/1975 | Grove | 418/61 B |
| 4,411,606 | 10/1983 | Miller | 418/61 B |
| 4,639,202 | 1/1987 | Mahanay et al. | 418/61 B |

*Primary Examiner*—John J. Vrablik
*Assistant Examiner*—Leonard P. Walnoha
*Attorney, Agent, or Firm*—Cushman, Darby & Cushman

[57] ABSTRACT

A hydraulic pump for a power steering apparatus is provided. Said pump comprises a housing, an outer gerotor element and a rotating inner gerotor element arranged within said outer gerotor element. A plurality of pressure chambers is defined and a pressure valve is assigned to each pressure chamber at the output side of the pump.

12 Claims, 8 Drawing Sheets

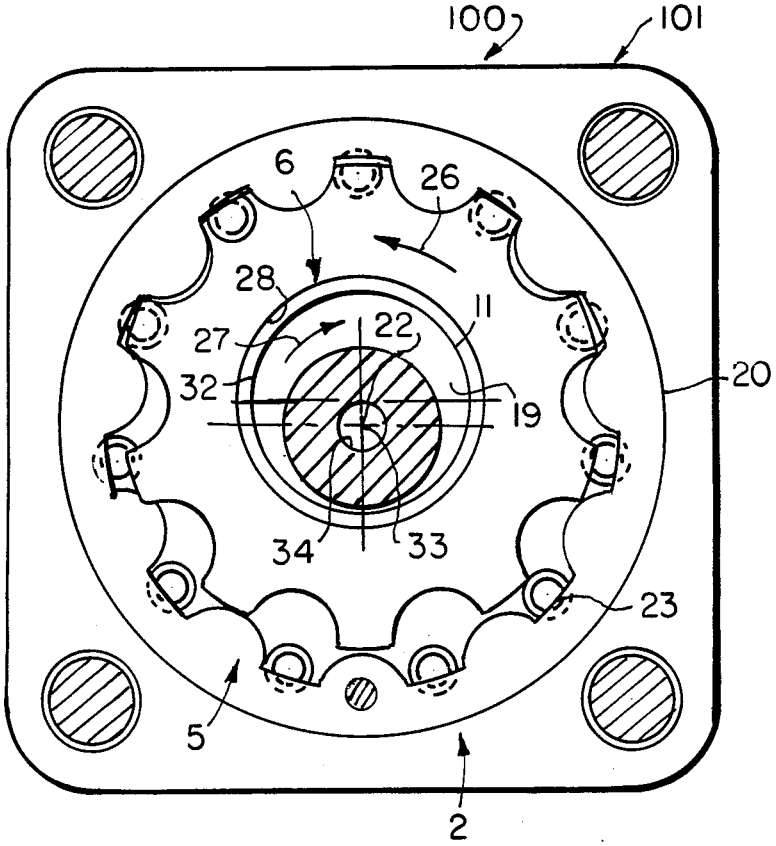
F I G. 2
F I G. 3
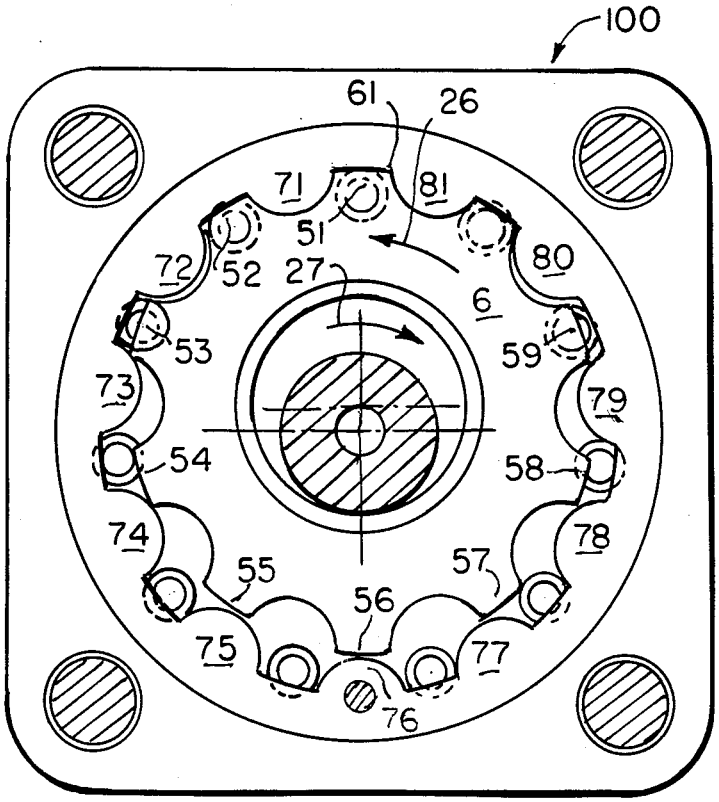

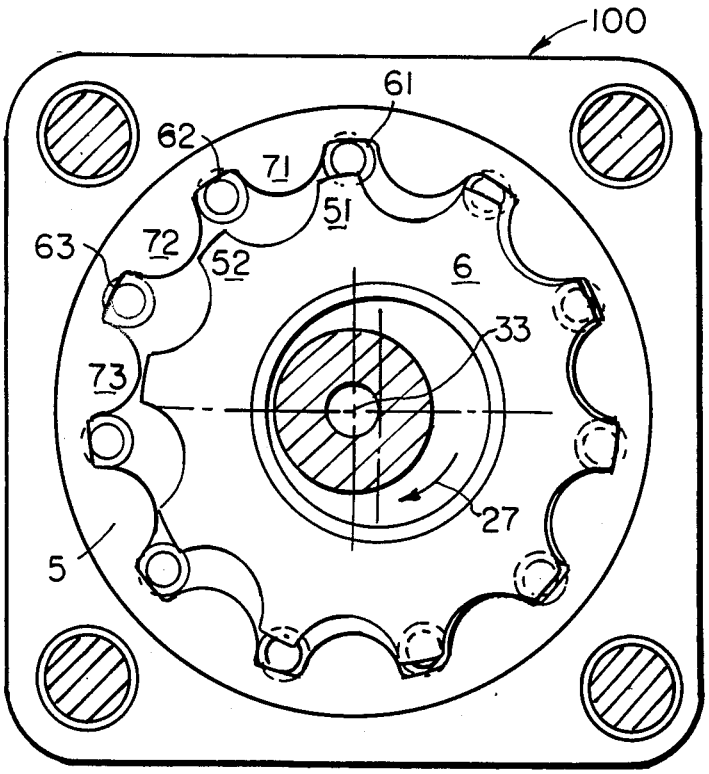
F I G. 4
F I G. 5
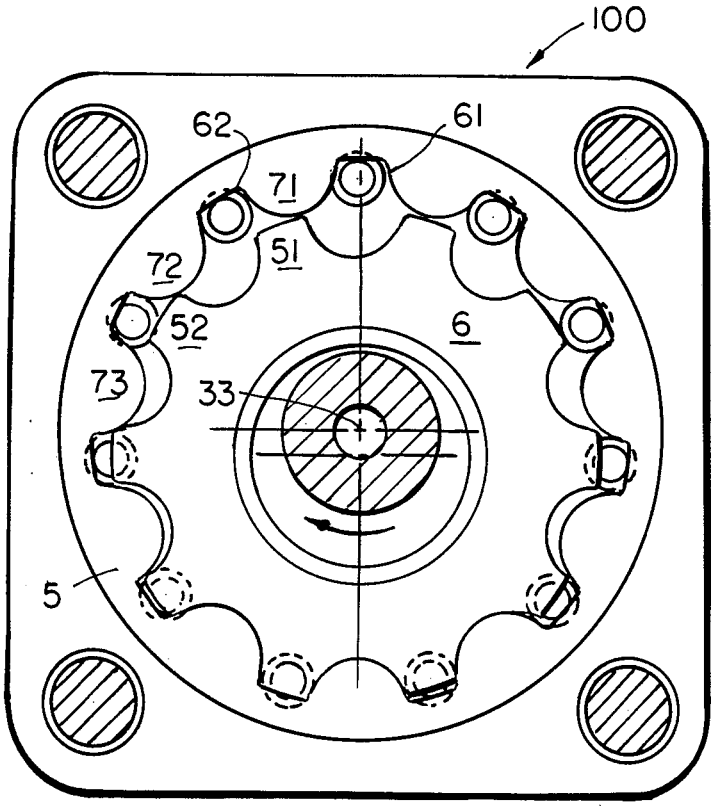

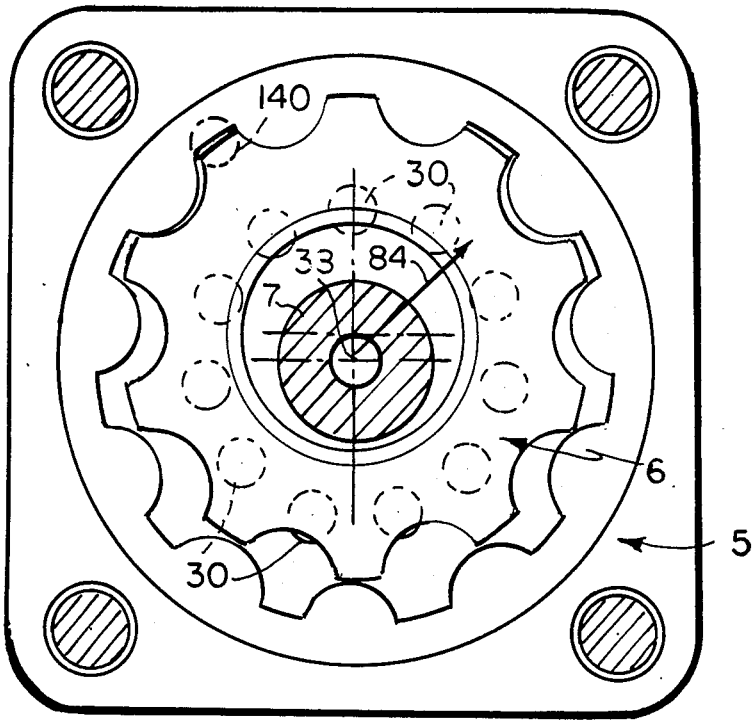
FIG. 8
FIG 9
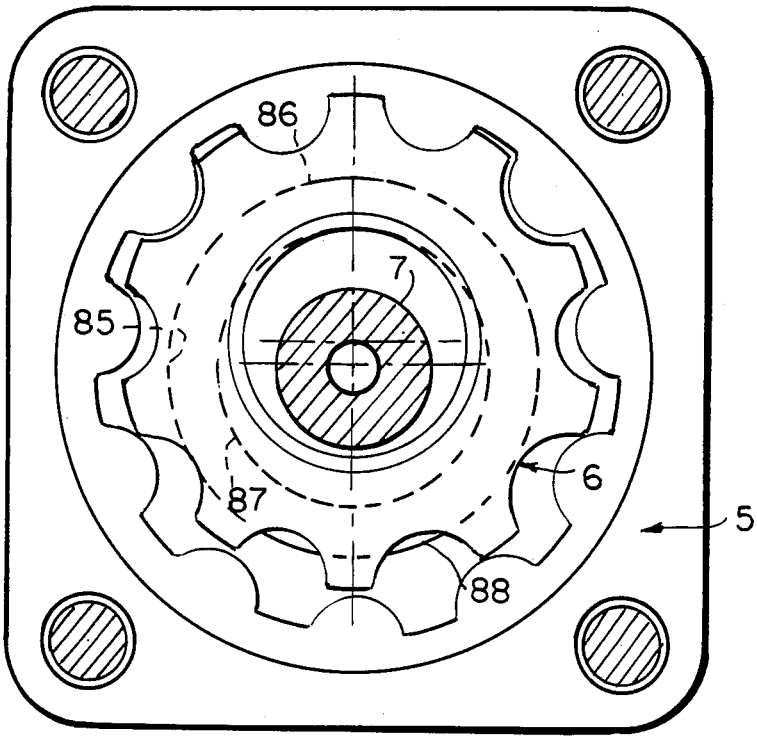

GEROTOR PUMP WITH PRESSURE VALVE AND SUCTION OPENING FOR EACH PRESSURE CHAMBER

TECHNICAL FIELD

This invention relates generally to a hydraulic pump, and in particular to a pump for a power-steering apparatus of a vehicle.

BACKGROUND ART

Various types of hydraulic machines are in use today. In particular, gerotor machines are known, i.e. a type of machine to which the present invention specifically refers. U.S. Pat. No. 3,453,966 discloses a hydraulic machine which can be used as a motor or as a hydraulic pump. A stationary outer gerotor element is provided which cooperates with a rotating inner gerotor element. When used as a pump, the inner gerotor element is driven via gear means by a shaft. This known hydraulic machine requires high manufacturing cost and rotating discs are required to control the supply and discharge of a pressure medium.

DE-OS No. 20 10 524, DE-AS No. 11 38 639 and U.S. Pat. No. 3,302,584 all disclose hydraulic machines using rotary control elements or control discs for controlling the flow of pressure medium. According to DE-OS No. 20 10 524 the discharge of pressure medium occurs via the rotating shaft. This requires the transfer of pressure medium from a stationary to a movable component which is not without problems.

Moreover, numerous hydraulic machines are known using rotating compression chambers with the result that stationary discs have to be used for supplying and removing pressure medium.

It is an object of the present invention to provide a hydraulic pump having a stationary outer gerotor element and a cooperating rotating inner gerotor element in such a manner that the amount of pressure medium supplied by the pump is limited with the consequence that the energy requirements of the pump are favourable, low manufacturing costs are achieved, and a good long-time operating performance can be maintained.

It is another object of the invention to provide a hydraulic pump for the power steering of a car such that the power requirement of the pump matches the requirements of the power steering apparatus so that only low losses of power occur in the pump.

DISCLOSURE OF THE INVENTION

In one aspect of the present invention a hydraulic pump is provided which comprises a housing. Within said housing an outer gerotor element is fixedly mounted and is provided with internal teeth means defining plurality of internal teeth. The outer gerotor element is generally annularly shaped and defines a center axis. A rotating inner gerotor element is arranged within said outer gerotor element and defines external gear means having a plurality of external teeth. Said external gear means and said inner gear means are in an engagement such that a sealing effect is caused between the outer gerotor element and the inner gerotor element. The number of the outer teeth is smaller by one than the number of the inner teeth. The outer teeth and the inner teeth define as many compression chambers as there are inner teeth. Driven means are provided for the inner gerotor element and are in engagement with said inner gerotor element. The driven means comprise a drive shaft rotatably mounted in said housing. The longitudinal axis of said drive shaft being located on said center axis of the outer gerotor element. Rotary motion transfer means are provided to effect a rotation of the inner gerotor element due to a rotation of the drive shaft. Said rotary motion transfer means comprise eccentric means provided on the drive shaft. Said excenter means being in rotary engagement with an inner running surface 28 of the inner gerotor element, with said inner running surface being arranged centrically with respect to said eccentric means. A pressure valve is assigned to each of said compression chambers.

In accordance with another aspect of the present invention a suction valve and a pressure valve is assigned to each one of said compression chambers.

In accordance with a further aspect of the invention a power steering apparatus pump is provided showing a so called suction throttling effect for which the compression chambers will not be filled after a predetermined speed is reached. For that purpose the size of the suction opening means (suction bores or suction slots) is selected such that beginning with a predetermined speed only an insufficient amount (as far as the filling of the pressure chambers is concerned) of pressure medium can enter the pressure chambers.

In accordance with another aspect of the present invention a hydraulic pump of the type defined above has the suction opening means (suction openings or slots) arranged such that the inner gerotor element acting as a rotary piston covers the suction opening means temporarily and opens only a partial area of the "phase" of the expanding volume of the pressure chamber for a connection between each suction opening means and and the compression or pressure chamber. This way the time during which pressure medium can enter is limited and consequently the amount of pressure medium entering is also limited. In this manner a suction throttling effect is achieved and a limitation of the amount of pressure medium supplied is provided. A pump of this type is advantageous as a so-called power steering pump.

Such a pump will supply up to a predetermined speed, the so-called down-control speed, an amount or volume of pressure medium proportional to the speed. Beginning with said down-control speed the suction throttling effect becomes effective and makes a complete filling of the suction chambers with pressure medium impossible.

By providing a pressure valve for each pressure chamber it is made impossible that a not completely filled pressure chamber can receive pressure medium from the load connected to said pump. If such pressure medium would be drawn into a pressure chamber from the load, it would also have to be compressed and this would mean a waste of energy.

On the other hand, conventional power steering pumps without suction throttling means will supply their user or load beginning with said down-control speed by means of a flow control valve an almost constant volume flow, while the remainder is removed by means of throttling and is fed back to the suction input of the pump. This, however, results in losses. The high energy losses occuring at high speeds and high operating pressures cause higher temperatures in the oil circuit and in the pump.

Piston pumps having suction throttling means are already known so as to provide for a supply of only the desired amount or volume of pressure medium. Such pumps are more expensive than for instance vane-type pumps and the kind of pump to which the present invention relates. Moreover, piston pumps with a small number of pistons have a relatively high pulsation in the pressure medium supplied by such pumps. An increase of the number of pistons, so as to reduce the pulsation, would again increase the price of such a pump.

BRIEF DESCRIPTION OF THE DRAWINGS

For a better understanding of the present invention, its advantages, and objects, reference may be made to the accompanying drawings in which:

FIG. 2 is a sectional view taken on line 1—1 in FIG. 1;

FIGS. 3–6 disclose the operation of the pump of FIGS. 1 and 2;

FIG. 8 is a sectional view on line 8—8 in FIG. 7, with the position of the suction means (suction bores) being shown;

FIG. 9 is a view similar to FIG. 8, however, relating to a different embodiment of the invention in so far as the suction means are not shown as bores, but in the form of an annular groove;

The hydraulic machine of the invention will be disclosed below by referring to different embodiments which disclose the preferred use of the hydraulic machine as a pump. Initially reference will be made to FIGS. 1–6 for explaining the general principle of the hydraulic machine and more particularly of the hydraulic pump of the invention. FIGS. 7–13 will be used to explain in some detail the suction process and the supply process of the pressure medium, specifically the suction throttling effect provided by the invention will be discussed.

Referring now to FIGS. 1–6, and more particularly, to FIGS. 1 and 2, a rotary piston pump 100 is disclosed as comprising a pump housing 101. The pump housing 101 comprises a flange housing 1, a cover 4 and, in between, a housing ring 2. The flange housing 1, the housing ring 2 and the cover 4 are held together in axial alignment by a plurality of circumferentially spaced bolts 17.

Figure 1:
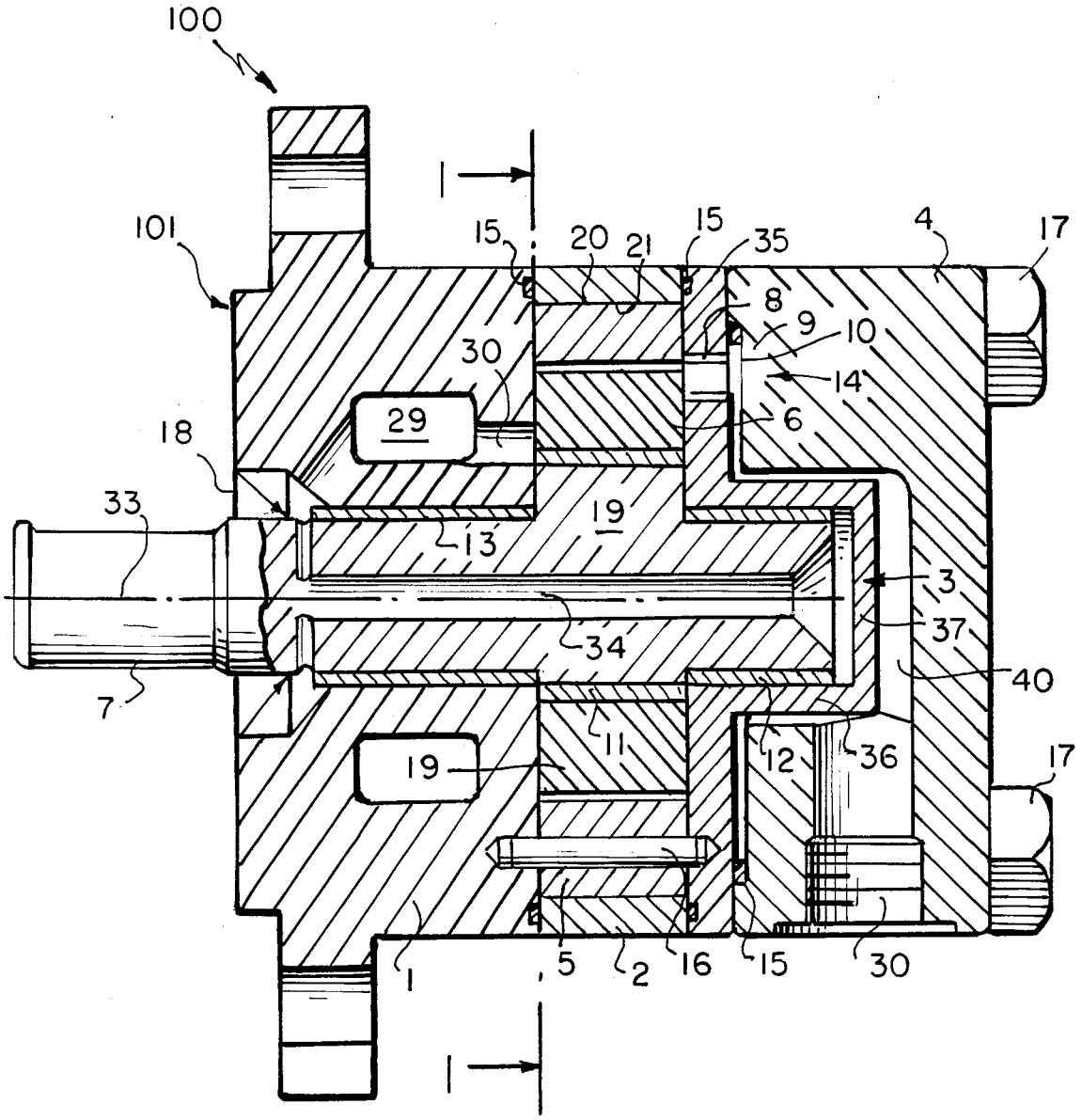
FIG. 1 is a longitudinal section of a first embodiment of a hydraulic pump of the invention.
Figure 6:
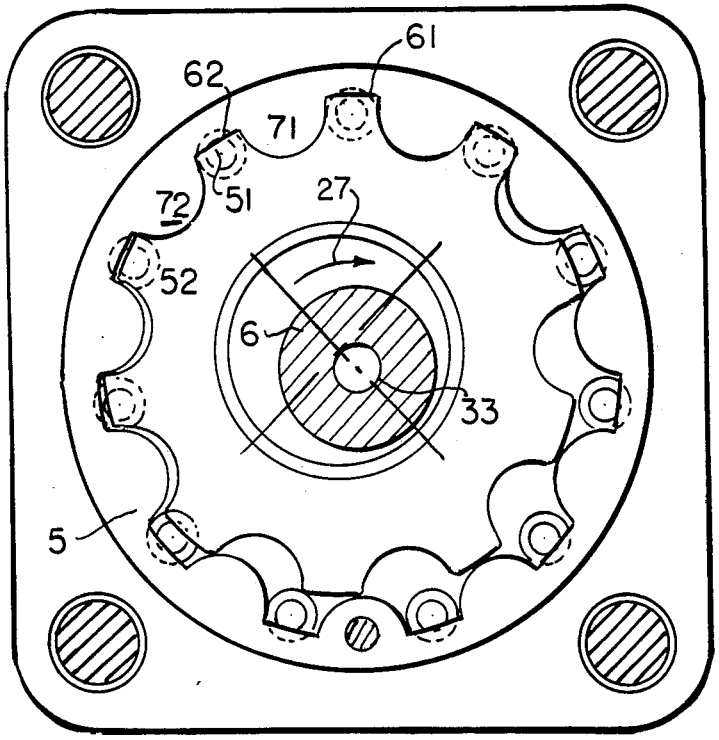

A shaft 7 is rotatably mounted in said housing 101 and comprises an eccentric disc (ecentric means) 19 in the area of the housing ring 2. The center of rotation and also the longitudinal axis of shaft 7 are referred to by reference numeral 33. The circular shaped outer running surface 32 of the eccentric means 19 is provided with a slide bearing 11. A toothed ring (also called an orbital ring or an inner gerotor element) 6 comprises an inner running surface 28 and is located with said inner running surface 28 on said slide bearing 11. The inner gerotor element 6 is provided with outer teeth means 24 and is in engagement with the inner gear means 23 of a stationary outer gerotor element 5, as is shown. The outer gerotor element 5 is provided with a circular shaped outer surface 20. The housing ring 2 has a circular bore 21 with which said outer surface 20 is in abutment.

It should be noted that a rotation of the shaft 7 is clockwise direction as shown by arrow 27 causes a counter-clockwise rotation represented by arrow 26 for the inner gerotor element 6.

In operation pressure medium is supplied from the outside via a suction port to an annular channel 29 in the flange housing 1. Said suction port is not shown in FIG. 1, but can be seen at 39 in FIG. 7. Suction bores 30 lead from the ring channel 29 to different compression or pressure chambers (which also act during part of rotation as suction chambers) yet to be described, which are formed between the inner gear means 23 and the outer gear means 24. After the pressure medium has been compressed in said pressure chambers (some are referred to by reference numerals 61, 62, 63 in FIG. 3) the pressure medium will be supplied via pressure valves 14 of the invention to a pressure chamber or space 40 in cover 4. From said pressure space 40 the pressure medium is supplied to pressure port 38 of the pump 100. Each pressure valve 14 comprises a valve seat 8, a valve plate 9 and a pressure spring 10.

Each one pressure valve 14 is assigned to each one pressure chamber 61, 62, 63 etc. A valve plate 3 is shown in FIG. 1 as being located between the housing ring 2 and the cover 4. The pressure valves 14 are inserted into said valve plate 3. In the embodiment as shown in FIG. 1 the pressure valves 14 extend partially also into said cover 4. Specifically, the valve plate 3 comprises a valve support member 35 which closes said compression chambers on one side. The valve plate 3 forms adjacent to the valve support member 35 an annular shaped bearing member 36 which extends concentrically with respect to said axis 33. The bearing member 36 extends into a recess of the cover 4 and is closed by a cover member 37. A friction bearing (sliding bearing) 12 is provided between the bearing member 36 and the shaft 7. The pressure space 40 already mentioned is formed between the cover 4 and the valve plate 3 and is naturally connected with the outlets of the pressure valves 14.

A cylindrically shaped pin 16 extends through corresponding bores in the flange housing 1, the outer gerotor element 5 and the valve plate 3, so as to fixedly mount said components with respect to rotation. O-rings 15 provide a seal between flange housing 1, housing ring 2, valve plate 3 and cover 4.

It should be noted that the shaft 7 is supported in the area of the flange housing 1 by means of a sliding bearing 13. Moreover an axial bore 34 extends through said shaft 7 and ends in a cross bore close to a shaft seal means 18. The bore 34 removes leakage oil via another bore 31 to the suction ring channel 25.

The operation of the rotary piston pump 10 of the invention will now be described in some detail by referring to FIGS. 3–6. It should be noted that the outer gear means of the inner gerotor element 6 comprises ten teeth 51–60. The inner gear means 23 of the stationary outer gear element 5 is defined by eleven teeth 71–81. Due to the rotation of the shaft 7 the volumes of the compression chambers formed between said inner gear means 23 and said outer gear means 24 are varied between the largest chamber volume and the smallest chamber volume. For that pupose the teeth of the inner gear means and of the outer gear means are formed such that, for all practical purposes, a sealing effect is caused between the individual chambers. Three of the eleven compression chambers formed by the teeth gaps of the outer gerotor element 5 are referred to by reference numeral 61, 62, and 63. In FIG. 3 the compression chamber 61 has reached its condition of lowest volume. In FIG. 4 chamber 61 has increased its volume due to the rotation of the shaft 7 in the direction of arrow 27. In FIG. 5 chamber 61 again has increased its volume, while the volume of chamber 61 in FIG. 6 has again become smaller. If one compares FIG. 3 with FIG. 6 one recognizes that the tooth 51 has moved by one tooth gap.

Based on the preceding description one recognizes that the rotary motion transfer means comprise eccentric means 19 located on said drive shaft 7. Said eccentric means 19 being in rotary engagement with the centric bore or the inner running surface 28 of the inner gerotor element 6. The friction bearing (sliding bearing) 11 already mentioned is preferrably located between said eccentric means 19 and the inner gerotor element 6. The center point of the eccentric means 19 is referred to by reference numeral 22.

For the operation of the rotary piston pump of the invention the supply and the removal of the pressure medium is of utmost importance. This will be explained below by referring to FIGS. 7–13.

Figure 7:
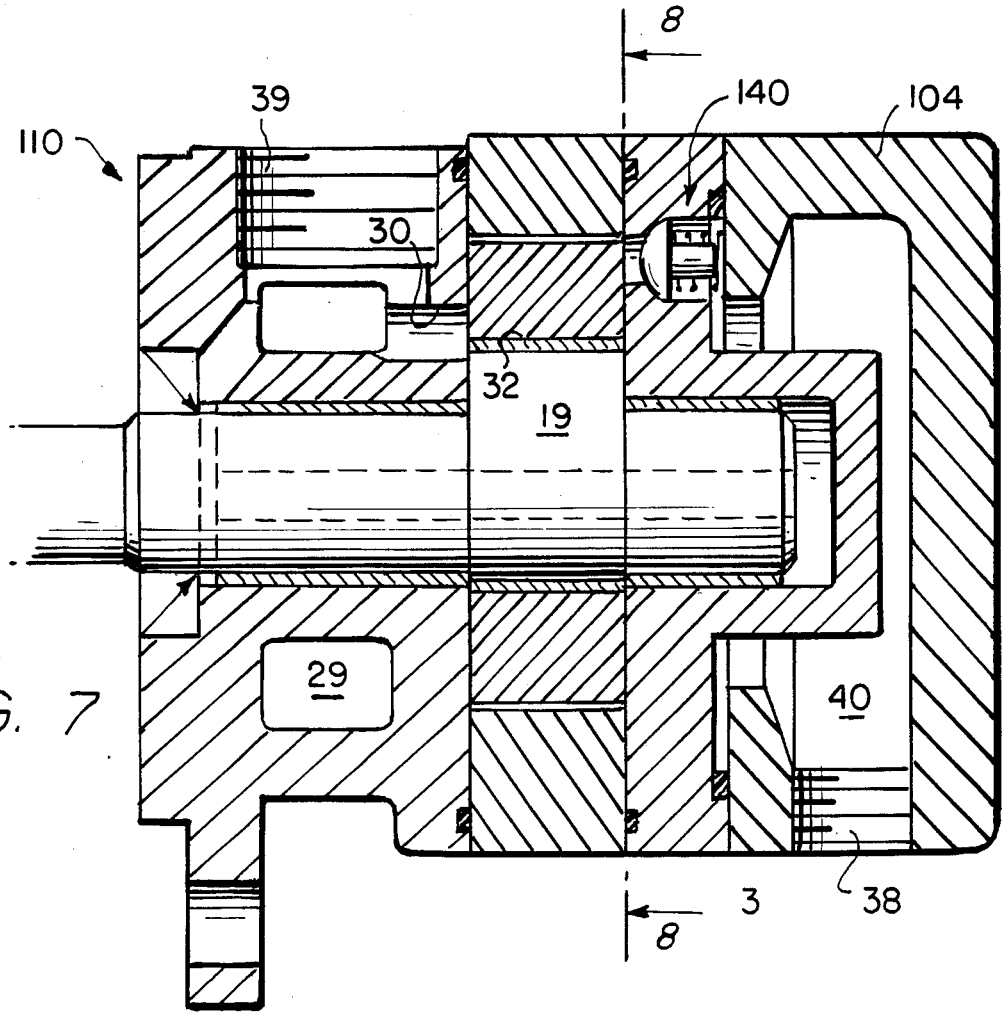
FIG. 7 is a longitudinal sectional view of a second embodiment of a pump.

FIG. 7 is a sectional view of a rotary piston pump 110 of a second embodiment of the invention. This piston pump is of similar design as the rotary piston pump 100 of FIG. 1. Insofar reference is made to the description of FIG. 1. The distinctions between the rotary piston pump 110 of FIG. 7 and the pump of FIG. 1 are as follows: FIG. 7 discloses the suction port 39 not shown in FIG. 1. For the pump of FIG. 7 the pressure valves 140 are located only in the valve plate 3, i.e. they do not extend into cover 104. The cover 104 is shown such that a larger pressure space 40 is created.

FIG. 8 schematically represents the location of the suction bores 30. The center points of all suction bores 30 are located on a circle having the center point 33 and the radius 84. One suction bore 30 is assigned to each one of said compression chambers 61, 62, 63 and so on.

In accordance with the invention the size of each of said suction bores 30 is determined such that the desired amount of throttling is achieved. I.e. beginning with a predetermined speed the size of the suction bore means is not sufficient to fill the corresponding pressure chamber (or suction chamber for that matter) completely. Because of the presence of the pressure valve at the output side of said chamber it is made impossible that pressure medium from the load connected to the pump can flow into said incompletely filled chamber. Such an inflow would create a power loss.

Preferably the size of each of said suction bores (suction bore means) is designed in accordance with the required suction throttling. This is also true for suction slots which will be discussed below.

In accordance with another embodiment of the invention the suction bores 30 can be positioned such that during operation of the pump a suction throttling effect is created for the pressure medium which is sucked-in by the pump.

Figure 13:
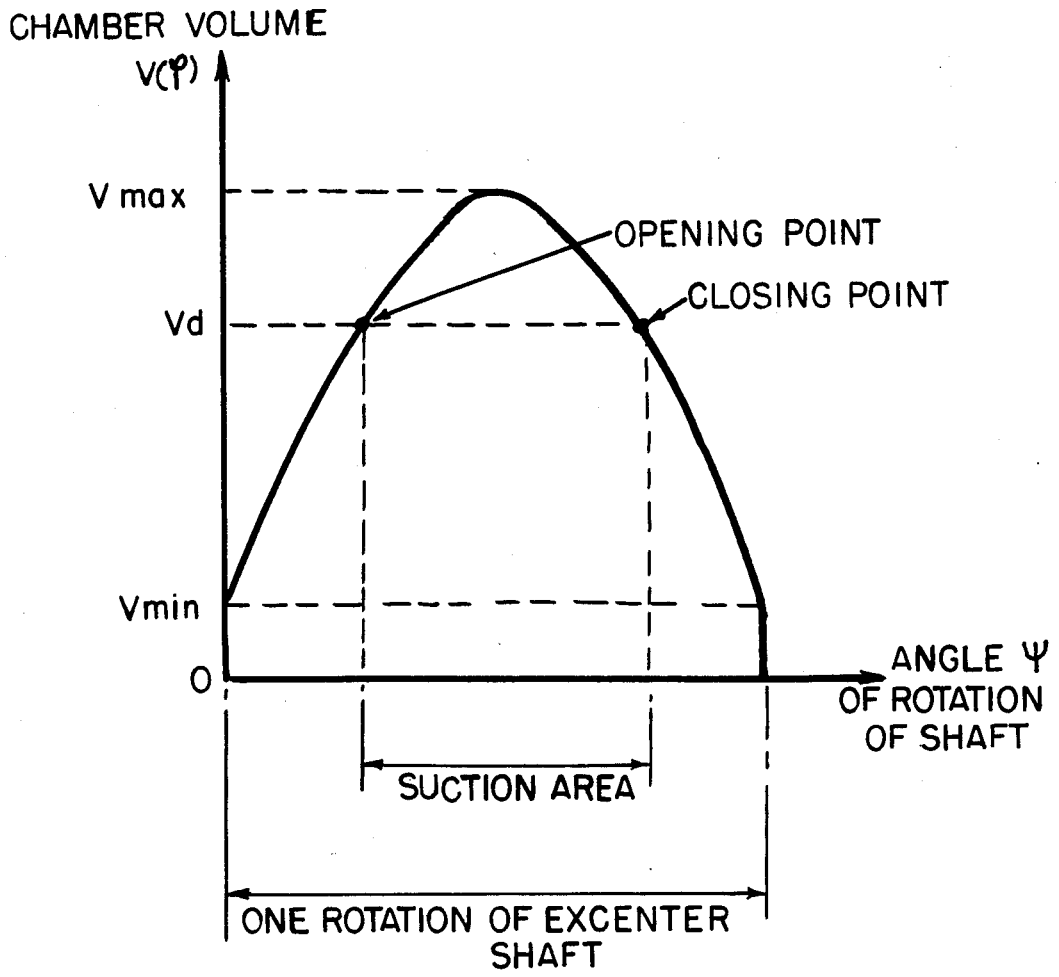
FIG. 13 is a qualitative representation of the change of the chamber volume depending on the angle of rotation of the shaft.

FIG. 13 shows for one compression chamber the volume of the chamber depending on the rotary angle of the shaft and the excenter means, respectively, for one rotation of the shaft. During one rotation of the shaft the volume of the compression chamber will increase from the minimum value Vmin to the maximum value Vmax and will then again drop to the minimum value Vmin. When the suction throttling effect occurs, a connection of the compression chamber with the suction bore will occur only beginning with a predetermined volume Vd of the compression chamber. This connection to the suction side of the pump remains in effect even after the maximum value Vmax has been passed and the connection to the suction side will be interrupted only after the volume of the compression chamber has been reduced to the value Vd. The opening point and the closing point for the suction opening therefore include a predetermined area of the rotary angle of the volume of the compression chamber.

The actual output of the pressure medium can only occur with reaching the closing point Vd. It is therefore possible to limit the effective displacement volume of the chamber. If the connection with the sump is already closed due to the positioning of the suction bores prior to reaching the maximum chamber volume $V_{max}$, then, initially, a proportional increase of the amount or volume of pressure medium is obtained with the increase of speed. Thereupon, with a continued increase of speed, a constant or even a falling amount or volume of pressure medium is provided. As was mentioned initially, such a constant or even a falling characteristic is desirable for instance for a power steering pump.

The suction bore (for each compression chamber) is located closer to the outer running surface 32 of the eccentric means 19. This is particularly true if the suction throttling effect is desired. On the other hand, the pressure valves are naturally located closer to the gaps of the inner gear means 23 of the outer gerotor element 5. This can be recognized in FIG. 7. FIG. 8 shows schematically the location or position of just a single pressure valve 140. In practice, one pressure valve 140 is assigned to each one chamber defined by the teeth gaps.

FIG. 9 discloses a different possibility for the arrangement of the suction opening means. Instead of single suction bores, an annular shaped suction channel 85 is provided which is formed for example by an annular shaped groove in the flange housing 1. Said groove is defined by two side walls 86 and 87. The suction groove or suction channel 85 is arranged such that a suction throttling effect is created as is shown in FIG. 9 for one chamber 88. Preferably, however, the suction throtteling effect will be achieved only by reducing the effective suction opening area of the suction groove 85.

Figure 10:
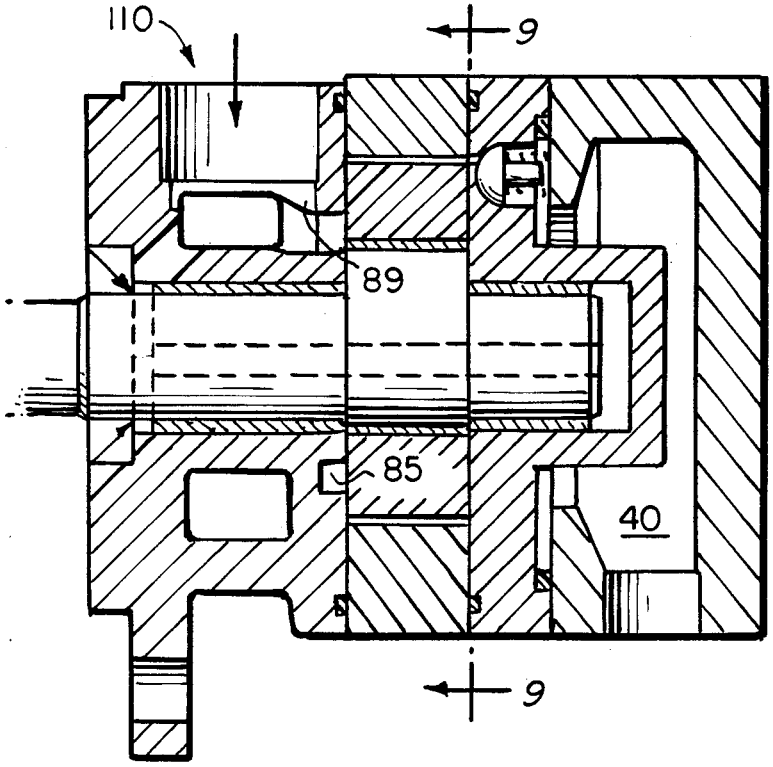
FIG. 10 is a longitudinal sectional view similar to FIG. 7 of an embodiment of a pump of FIG. 9.

FIG. 10 discloses the suction channel 85 in a sectional view corresponding to FIG. 7. Just one bore 89 is required to supply pressure medium to the suction channel 85. It is also possible to design the area of the of bore 89 so small that the desired suction throtteling effect is reached.

Figure 11:
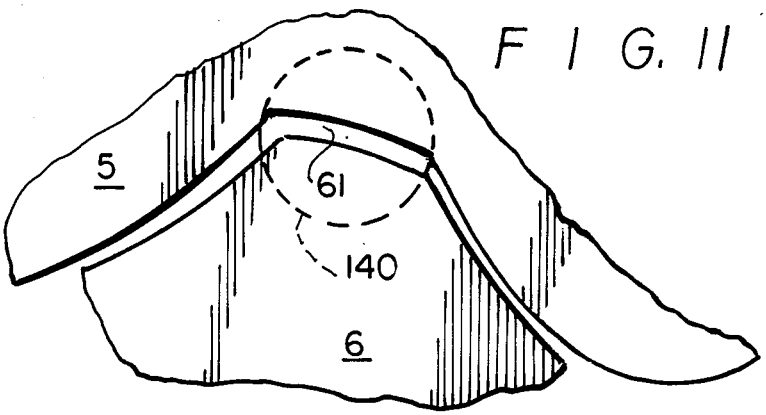
FIG. 11 is a detail of the engagement of the pump elements.

FIG. 11 shows schematically for one chamber 61 the condition where the smallest chamber volume has been reached. At the same time the position of the pressure valve 140 assigned to said chamber 61 is schematically shown.

Figure 12:
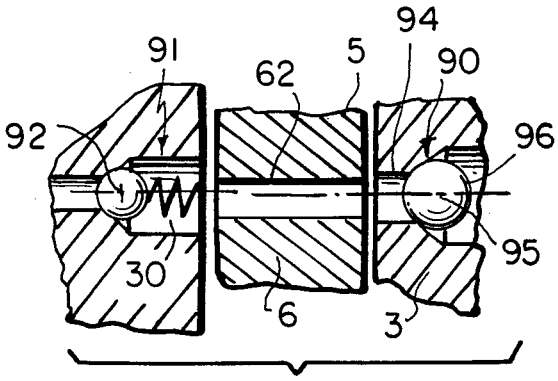
FIG. 12 is a detail relating to the possible arrangement of the suction and pressure valves.

FIG. 12 discloses a detail according to which a pressure valve 90 is located adjacent to a chamber 62 together with a suction valve 91 which is located diamatrically oppositely thereto. Instead of a suction valve simply a suction bore could be shown. The suction valve 91 is located in the suction bore 30 and comprises the schematically shown ball 92 as well as an appropriate closing spring 93. The pressure valve is located in a pressure bore 94 and also comprises a ball 95 and a spring 96. Each such suction valve 91 and each such pressure valve 90 is assigned to each chamber 62. Such an arrangement can be used where a suction throttling effect is not required and the chambers are to be filled as completely as possible.

As was mentioned above, the inner gear means 24 has one tooth less than the outer gear means 23. Apparently, it is not necessary to use just ten inner teeth and eleven outer teeth and consequently eleven chambers. Any other number of chambers is conceivable.

During the operation of pump 100 or pump 110 the shaft 7 is rotated, so that the inner gerotor element 6 rotates about its own axis in opposite direction with a speed equal to the speed of the shaft 7 divided by the number of the teeth of the inner gerotor element 6. At the same time the inner gerotor element carries out an orbital movement about the axis of shaft 7 with a frequency which corresponds to the speed of the eccentric means 19. The inner gerotor element can also be called a rotary piston.

As outlined above, the present invention provides in particular for a pump adapted to supply a power steering apparatus for a vehicle. The amount of fluid supplied by said pump will initially increase with an increase in the speed, but will, beginning with a predetermined speed, the so-called down-control speed, supply with increasing speed a constant or even a slowly decreasing amount of fluid. Therefore, the pump will require for its operation a small amount of power. The pump of the invention can be manufactured at low cost. Preferably, a pressure valve is provided for each pressure chamber. It particular, a combination of one pressure valve per pressure chamber and suction openings arranged there as to be controlled by the inner gerotor element will be provided.

Figure 14:
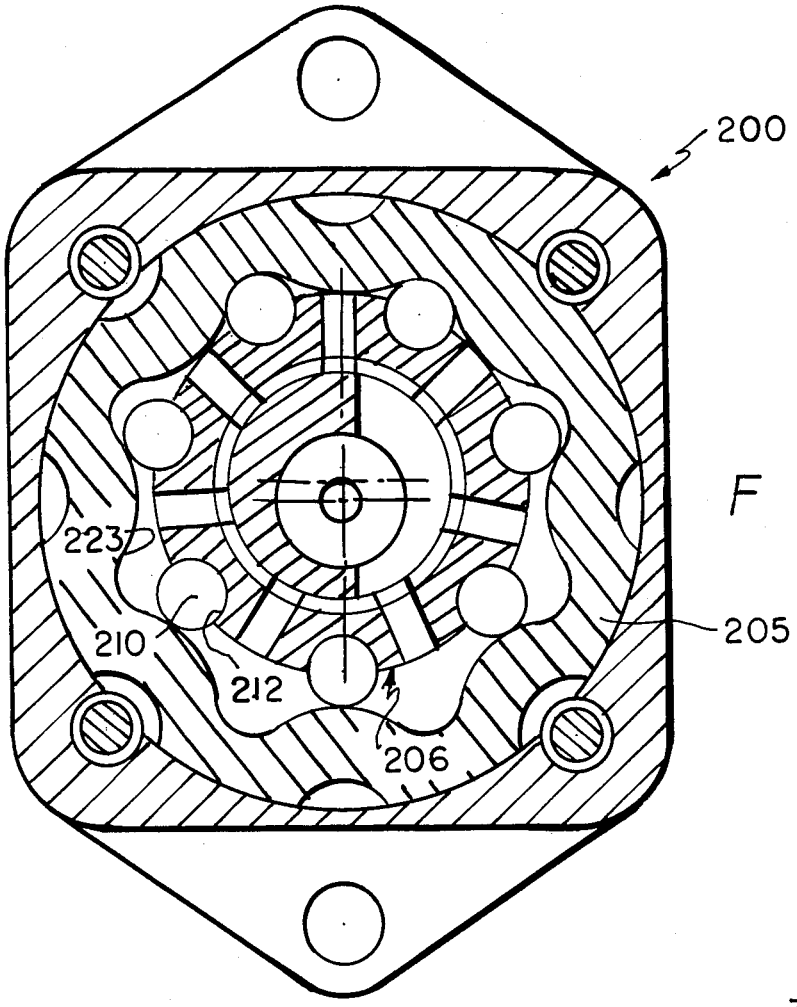
FIG. 14 is another embodiment of the invention having rollers on the inner gerotor element.

The embodiments of the invention discussed above use an inner gerotor element 6 which is provided at its outer circumference with a tooth-like contour, so as to form an outer gear means 24. So as to provide for a good sealing between the individual chamber 61, 62, 63 the inner gerotor element 6 has to fit exactly with the inner contour of the outer gerotor element 5, so that relatively high manufacturing cost will ensue. FIG. 14 discloses an embodiment of a hydraulic pump 200 where the outer contour of the inner gerotor element 206 is provided with pocket-like recesses (pockets) 212 into which rollers 210 are inserted. If one of the chambers is pressurized, the rollers 210 will be subject to a sealing pressure between the inner gerotor element 206 and the outer gerotor element 205. Therefore, the rollers 210 are in a sealing line contact with the inner contour or the inner tooth means 223 of the outer gerotor element 205. For other details of the embodiment of FIG. 14 as well as the embodiment of FIG. 15, yet to be described, reference is made to the embodiment of FIGS. 1 and 2.

Figure 15:
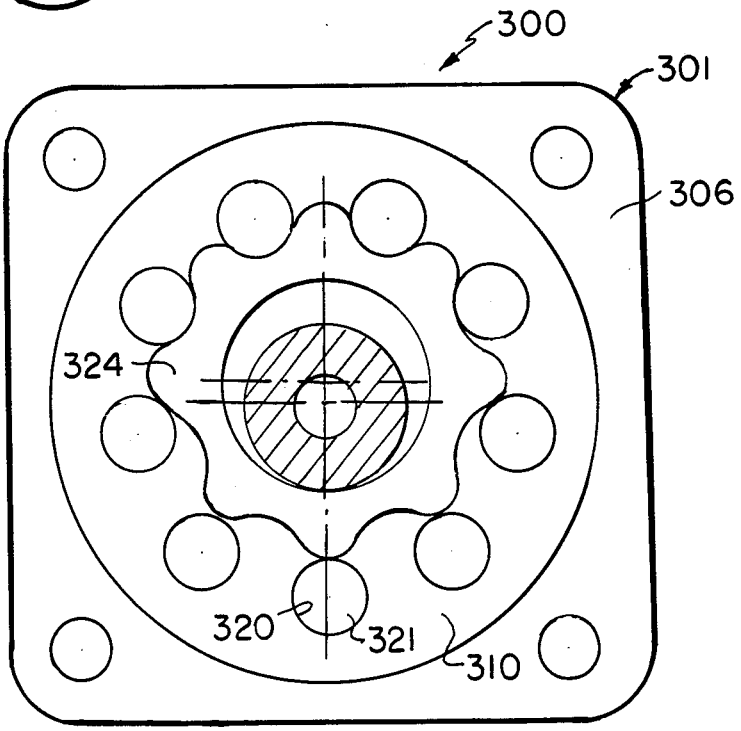
FIG. 15 is another embodiment of the invention having rollers on the outer gerotor element.

With reference to FIG. 15 it is noted that the inner contour or the inner gear means of the outer gerotor element 305 cannot be easily manufactured, the embodiment of FIG. 15 provides for the following:

Instead of the gerotor element 5 in FIG. 1 having an inner contour 23 which is difficult to be manufactured, the outer gerotor element 305 of FIG. 15 comprises simply a ring 310 which can be inserted into the pump housing 301 of the pump 300 shown in FIG. 15. Ring 305 is provided at its inner circumference with pocket-like recesses (pockets) 320. In each of said pockets 320 a roller 321 is contained. At the same time, the meshing inner gerotor element 306 is provided with a corresponding outer contour 324. The outer contour 324 can be manufactured easier inasmuch as it is located on the outer circumference of the gerotor element 306.

I claim:

1. A hydraulic pump for a power steering apparatus, said pump comprising at its input side suction opening means for the intake of a pressure medium, particularly hydraulic oil, and supplies said pressurized pressure medium at the output side, said pump further comprising:

a housing (101), an outer gerotor element (5) fixedly mounted within said housing (101) and having inner gear means (23) defining a plurality of inner teeth (71–81), said outer gerotor element (5) being of generally circular shape and defining a center axis (33), a rotating inner gerotor element (6) arranged within said outer gerotor element (5) and being provided with outer gear means (24) defining a plurality of outer teeth (51–69), said outer teeth means (24) being adapted to mesh with said inner gear means (23) such that a sealing effect is caused between the outer gerotor element (5) and the inner gerotor element (6), wherein the number of outer teeth is smaller by the number 1 than the number of the inner teeth, and wherein a plurality of pressure chambers (62) are defined, said plurality being equal to the number of inner teeth, drive means for the inner gerotor element (6) arranged in engagement with the inner gerotor element, said drive means comprising a drive shaft (7) rotatably mounted in said housing (101), wherein the longitudinal axis (33) of said drive shaft (7) being located on the center axis (33) of the outer gerotor element (5), rotary motion transfer means for effecting a rotation of the inner gerotor element (6) based on the rotary motion of the drive shaft (7), an eccentric (19) provided on said drive shaft (7) and in rotary engagement with an inner running surface (28) of the inner gerotor element (6) located centrally within said inner gerotor element (6), and wherein a pressure valve (90) is assigned to each pressure chamber (62) at the output side of the pump, and wherein each pressure chamber is provided with a suction opening (83), with the inner gerotor element controlling the suction openings for the individual pressure chambers depending on the angle of rotation of the eccentric such that, within a range of angles around the maximum chamber volume of each appropriate chamber, connection between the chamber and the corresponding suction opening exists while in the remainder of the range of rotary angles of the eccentric, the connection between the chamber and suction opening is closed.

2. The hydraulic pump of claim 1 wherein the housing (101) comprises a flange housing (1), a cover (4) and a housing ring (2) located between the flange housing (1) and the cover (4).

3. The hydraulic pump of claim 1 wherein a valve plate (3) is provided for receiving said pressure valves.

4. The hydraulic pump of claim 3 wherein the inner gerotor element rotates in the area of the housing ring (2) and the valve plate (3) is located between the cover (4) and the housing ring (2).

5. The hydraulic pump of claim 1 wherein a pressure space is formed in the cover (4), said pressure space being connected on its input side with the outlets of the pressure valves and is further connected at its output side with the pressure port (38) of the pump.

6. The hydraulic pump of claim 1 wherein the suction opening means comprises one suction valve for every pressure chamber.

7. The hydraulic pump of claim 1 wherein the size of the suction opening means is provided such that for a desired predetermined speed of the pump a suction throttling effect is caused, i.e. the pressure chambers are not completely filled any more, so as to achieve a limitation of the amount of pressure medium being pumped.

8. The hydraulic pump of claim 1 wherein the outer gerotor element (5) is held fixedly with respect to the housing by means of at least one pin (16).

9. The hydraulic pump of claim 1 wherein the suction openings are provided in the form of bores.

10. The hydraulic pump of claim 1 wherein the suction openings are formed by a common annular suction channel.

11. The hydraulic pump of claim 1 wherein the outer contour of the inner gerotor element (206) is provided with pocket-like recesses (212) into which rollers (210) are inserted, wherein said rollers (210) are sealingly pressed between the inner gerotor element (206) and the outer gerotor element (205) and with the inner contour of the outer gerotor element (205), so as to provide a sealing line contact therebetween.

12. The hydraulic pump of claim 1 wherein the outer gerotor element (305) comprises a ring which can be inserted into the pump housing, said ring being provided at its inner circumference with pocket-like recesses (320), each one adapted to receive a roller, and wherein the appropriate inner gerotor element (306) is provided with a corresponding outer contour (324).

* * * * *